US005319328A

United States Patent [19]

Turunen

[11] Patent Number: 5,319,328

[45] Date of Patent: Jun. 7, 1994

[54] DIELECTRIC FILTER

[75] Inventor: Aimo Turunen, Kempele, Finland

[73] Assignee: LK-Products OY, Kempele, Finland

[21] Appl. No.: 906,204

[22] Filed: Jun. 25, 1992

[30] Foreign Application Priority Data

Jun. 25, 1991 [FI] Finland ..... 913084

[51] Int. Cl.[5] ..... H01P 1/201

[52] U.S. Cl. ..... 333/202; 333/206

[58] Field of Search ..... 333/202, 206, 222, 223, 333/224, 225, 226, 202 DB

[56] References Cited

U.S. PATENT DOCUMENTS

| | | | |
|---|---|---|---|
| 3,973,226 | 8/1976 | Affolter et al. | 333/202 |
| 4,028,652 | 6/1977 | Wakino et al. | 333/73 W |
| 4,255,729 | 3/1981 | Fukasawa et al. | 333/202 |
| 4,431,977 | 2/1984 | Sokola et al. | 333/206 |
| 4,464,640 | 8/1984 | Nishikawa et al. | 333/202 |
| 4,559,508 | 12/1985 | Nishikawa et al. | 333/202 |
| 4,692,726 | 9/1987 | Green et al. | 333/206 |
| 4,703,291 | 10/1987 | Nishikawa et al. | 333/202 |
| 4,716,391 | 12/1987 | Moutrie et al. | 333/206 |
| 4,740,765 | 4/1988 | Ishikawa et al. | 333/206 |
| 4,745,379 | 5/1988 | West et al. | 333/206 |
| 4,800,347 | 1/1989 | Yorita et al. | 333/202 |
| 4,800,348 | 1/1989 | Rosar et al. | 333/202 |
| 4,821,006 | 4/1989 | Ishikawa et al. | 333/202 |
| 4,829,274 | 5/1989 | Green et al. | 333/202 |
| 4,942,377 | 7/1990 | Ishikawa et al. | 333/202 |
| 4,954,796 | 9/1990 | Green et al. | 333/206 |
| 5,023,579 | 6/1991 | Bentivenga et al. | 333/203 |
| 5,103,197 | 4/1992 | Turunen et al. | 333/206 |
| 5,113,310 | 5/1992 | Kuroki et al. | 333/202 |
| 5,115,373 | 5/1992 | Takeda | 333/202 |

FOREIGN PATENT DOCUMENTS

| | | | |
|---|---|---|---|
| 0208424 | 1/1987 | European Pat. Off. . | |
| 0324453 | 7/1989 | European Pat. Off. | 333/206 |
| 909755 | 7/1949 | Fed. Rep. of Germany | 333/202 |
| 2412759 | 9/1975 | Fed. Rep. of Germany | 333/202 |
| 0105602 | 6/1983 | Japan | 333/202 |
| 114503 | 7/1983 | Japan . | |
| 101902 | 5/1984 | Japan . | |
| 161806 | 7/1986 | Japan | 333/206 |
| 312701 | 12/1988 | Japan | 333/206 |
| 94901 | 4/1990 | Japan | 333/206 |
| 7301995-2 | 2/1972 | Sweden . | |
| 1218428 | 3/1986 | United Kingdom | 333/202 |
| 2174849 | 11/1986 | United Kingdom | 333/206 |
| 2174849A | 11/1986 | United Kingdom . | |
| 2184608 | 6/1987 | United Kingdom | 333/202 |
| 3906286 | 8/1990 | United Kingdom | 333/202 |
| 2234398 | 1/1991 | United Kingdom | 333/202 |
| 2234399 | 1/1991 | United Kingdom | 333/202 |
| 2236432 | 4/1991 | United Kingdom . | |

OTHER PUBLICATIONS

Patent Abstracts of Japan, vol. 8, No. 235 (E-275) Oct. 27, 1984 & JP-A-59 117 302 (Fujitsu K.K.) Jul. 6, 1984.

Patent Abstracts of Japan-vol. 7, No. 292 (E-219)(1437) Dec. 27, 1983 & JP-A-58-168 302 (Fujistu K.K.) Oct. 4, 1983.

Patent Abstracts of Japan-vol. 5, No. 11(E-42)(683) Jan. 23, 1981 & JP-A-55 141 802 (Alps Denki K.K.) Nov. 6, 1980.

Patent Abstracts of Japan-vol. 12, No. 106(E-596)(2953) Apr. 6, 1988 & JP-A-62 235 801 (Fuji Electrochem Co., Ltd.) Oct. 16, 1987.

*Primary Examiner*—Raymond A. Nelli

*Attorney, Agent, or Firm*—Darby and Darby

[57] ABSTRACT

Harmonic frequencies of a ceramic filter (1) can be efficiently attenuated by placing in a hole (2; 3) of a first and/or last resonator a conductive rod (7; 7'), on which disk-like insulating plates (9, 10, 11, 12; 9', 10', 11', 12') are provided in spaced relationship along the length of the rod. The harmonic filter thus formed is a low pass filter, comprising transverse capacitances formed by the insulating plates and longitudinal inductances formed by the rod portions between the plates. Coupling between the harmonic filter and the resonators of the main filter takes place at the upper end of the rods (7, 7').

10 Claims, 2 Drawing Sheets

DIELECTRIC FILTER

Figure 1:
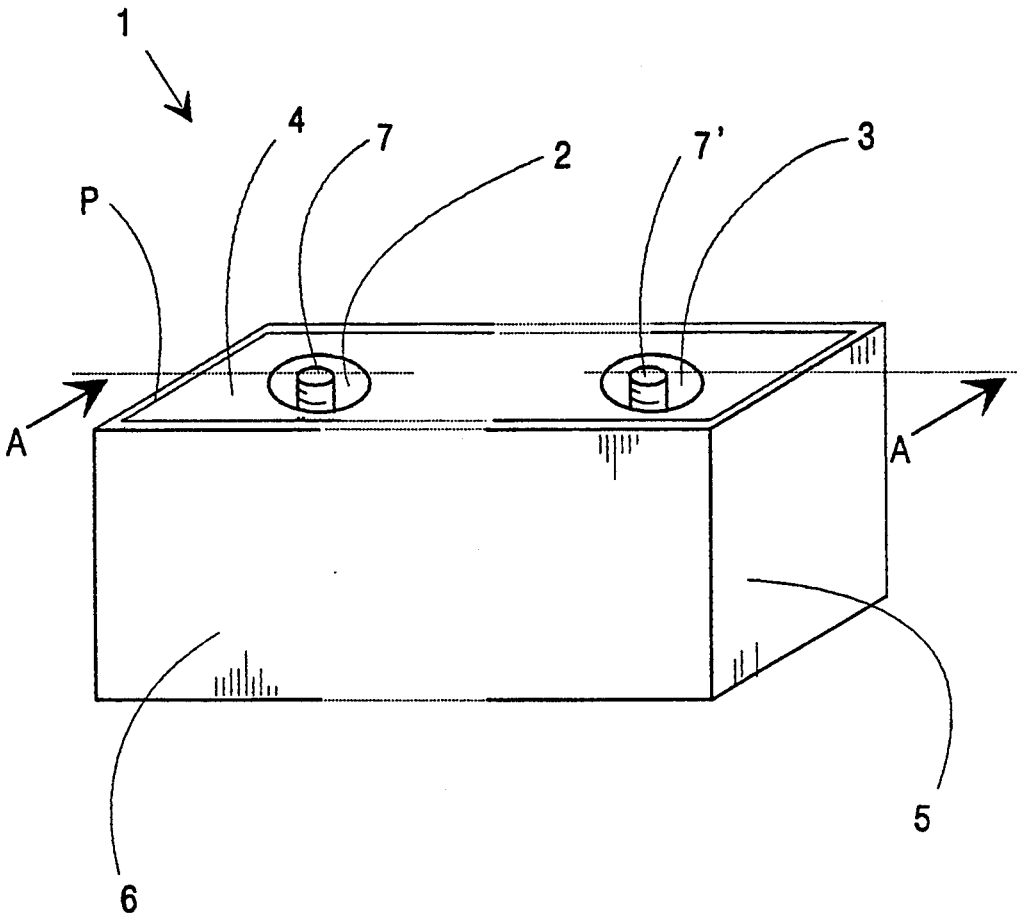

The present invention relates to a filter comprising a body of dielectric material having upper and lower surfaces, the body having major portions coated with a conductive material, at least two holes extending from the upper surface towards the lower surface and being coated with conductive material, whereby a respective transmission line resonator is formed for each hole.

Such a filter is generally provided with means for intercoupling adjacent resonators, and input and output terminals for applying and extracting an RF signal.

This type of dielectric filter is well known in the filter technology and used because of certain good features thereof. A ceramic material is commonly used for the dielectric body. Due to the high dielectric constant of ceramic material, the size of the filter can be small in comparison with, for instance, a helical filter operating in the same frequency range. The power endurance is high and both the mechanical and temperature stability are good. At one end the conductive coating of the resonator hole is joined with the coating on the side faces of the dielectric body, but a gap is left in the coating at the other end of the hole to provide an unconductive area. Eelectrically, the coated hole is an inner conductor of the resonator and the outer conductor is composed of the coating on the side faces of the dielectric body. This type of resonator in which one end of the inner conductor is open and the other end is short-circuited, in this manner corresponds to a $\lambda/4$ resonator, the basic resonat frequency thereof being determined in this case by the length of the hole and by the loading capacitance at the open end thereof. Such a resonator does not, however, oscillate only at the basic resonat frequency, but the $\lambda/4$ resonator also oscillates at the odd multiples of the basic freuqency, i.e. in the odd harmonics. For separating the different modes of oscillation, a mode index M is used. This index indicates how many times a voltage (or current) distribution of a $\lambda/4$ length is included along the longitudinal axis of the resonator. Thus, according to this principle, for the $\lambda/4$ resonator $M=1$ for the fundamental frequency, for the first harmonic thereof $M=3$, the second harmonic $M=5$, etc. The characteristic impedance together with the steepness of the impedance of the resonators with various mode indices vary linearly with index M. This means that if the normalized characteristic impedance is measured for example with $M=1$ and $M=2$ of mode index, in a given frequency, the reactive impedance component of a resonator with $M=2$ is considerably higher than that of the resonator with $M=1$. When the mode index increases, the normalized characteristic impedance of a resonator approaches the value 1.

In certain filter applications said mode indices can be made use of, though frequently it is desirable that a given resonator oscillates only at the fundamental frequency but not at the harmonic frequencies. In this latter case the undesirable harmonic frequencies may be attenuated by means of a narrow bandwidth notch filter. A separate notch filter can be constructed in front of the main filter, tuned to the frequency of the harmonic desired to be removed. The notch filter may be arranged as a continuation of the main filter. It may be enclosed in a common housing with the main filter. For constructing a notch filter, a different technology may be used than for the main filter; it is known in the art, for instance, to encapsulate into one housing a filter composed of helix resonators, and a notch filter implemented by means of surface wave technology, a so-called SAW filter (Surface Acoustic Wave).

Using this kind of notch filter for separate harmonic frequencies causes certain difficulties. The filter has to be produced in a separate process from the main filter and to be combined thereto during assembly. This adds a number of additional process steps and potential sources of errors in manufacturing the filter. A separate harmonic filter encapsulated in a common housing tends to increase the size of the filter and hence the amount of space needed on the circuit board to which the filters are affixed. A further disadvantage of a separate filter is the difficulty of arranging sufficiently efficient RF shielding.

According to the present invention a filter having the features recited in the opening paragraph is characterized in that means are provided in at least one of the resonator holes for filtering frequencies higher than the desired operating frequency of the filter.

The present invention is based on the basic idea that a resonator hole of the ceramic resonator can be made use of to accommodate a filter for the harmonic frequencies. In this hole there may be provided a small-sized harmonic filter comprising a ladder network consisting of serial inductances and shunt capacitances. A first harmonic filter can be positioned in a first resonator hole of the ceramic filter, whereby the input signal for the ceramic filter is applied from below into the harmonic filter, i.e. through the shortcircuited end of the resonator hole of the first circuit. Coupling into the main filter, i.e. into the first resonator thereof will take place at the load capacitance end of said resonator. In this manner the frequencies higher than the operational frequency have already been filtered off from the signal prior to being applied to the ceramic filter. A second harmonic filter may also be provided in the last ceramic resonator hole, whereby the output signal is coupled from the last resonator to the harmonic filter at the upper end thereof, and the output signal of the entire filter circuit can be derived from the lower end of the harmonic filter. Using two harmonic filters substantially enhances filtering.

Figure 2:
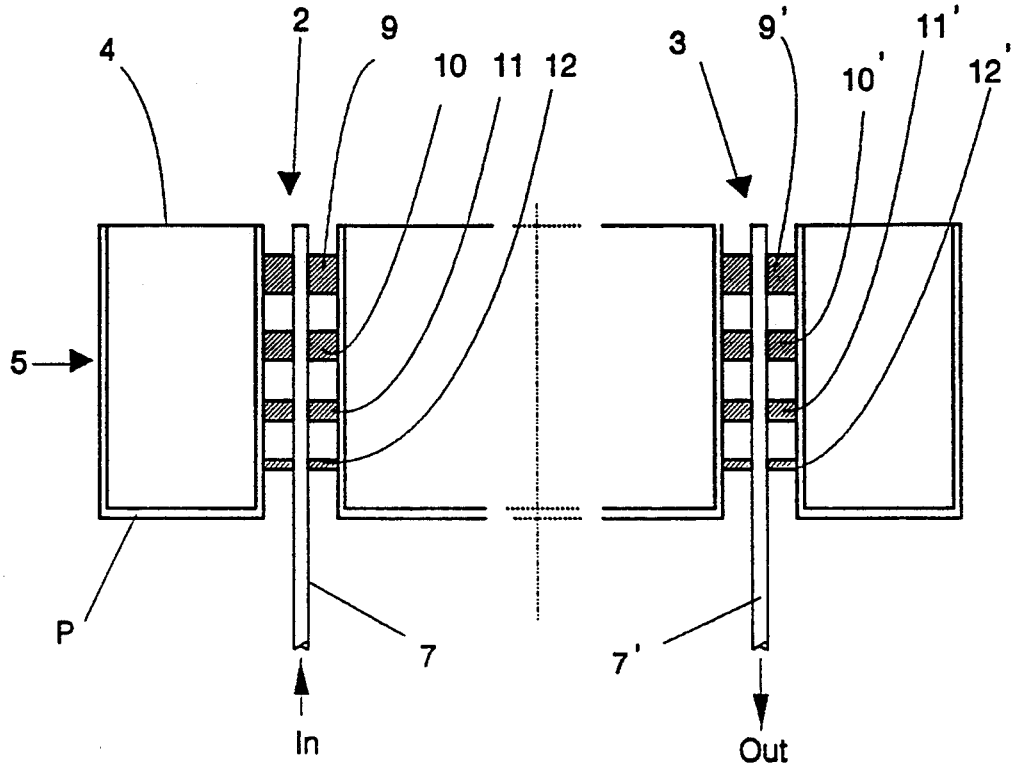
Figure 3:
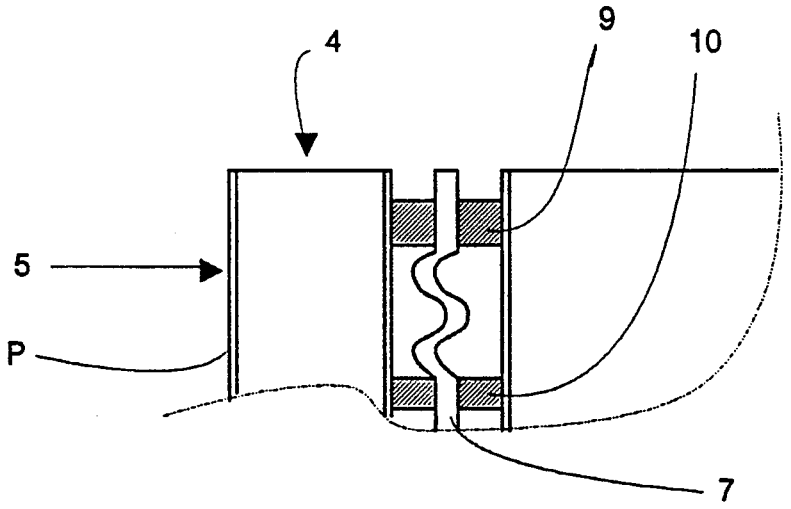

Embodiments of the invention will now be described, by way of example, with the aid of the accompanying FIGURES in which FIG. 1 is a perspective view of part of a dielectric filter in accordance with the invention, FIG. 2 is a cross-section of the filter along the line A—A in FIG. 1, and FIG. 3 is a cross-section of a modified filter in accordance with the invention.

Reference is first made to FIGS. 1 and 2. Reference numeral 1 refers to part of a ceramic filter comprising a number of resonators, in which only the outermost, i.e. the first and last resonators are shown. The filter comprises, as is known in the art, a block 1 made of a ceramic material, of which FIG. 1 shows upper surface 4, end surface 5 and side surface 6. All surfaces, with the exception of the upper surface 4, or at least some areas of the surface surrounding holes 2 and 3 have been coated with a well conductive layer P. The surfaces of the holes 2 and 3 have been likewise coated with the conductive layer and the coating is joined with the coating on the lower surface of the block. Electrodes (not shown) may be provided for coupling into the resonators. Within the hole 2 of the first resonator is provided a first harmonic filter 7 in accordande with the invention, and within the hole of the last resonator a similar harmonic filter 7' is provided. Only the ends of the filters are visible in FIG. 1. The cross-sectional FIG. 2 shows the construction of the harmonic filters, which will now be described in more detail.

The harmonic filter provided concentrically in the first resonator hole 2 of the ceramic filter comprises a conductive rod 7, on which disk-like insulating plates 9, 10, 11 and 12 have been mounted at certain intervals. The rod 7 extends through the centre of the plates and is fastened thereto. When the plates are of ceramic material, it is advantageous to coat the hole surface with a conductive metal layer whereafter the plate is soldered to the rod. If the plates are of a plastic compound, they can be fastened to the rod by clamping or by using a conductive adhesive. The insulating plates are made of a material with a high dielectric constant, preferably of the same ceramic material as the resonator block. When operating at high frequencies, the open portions of the rod 7 constitute respective inductances, wherebetween are located shunt capacitances produced by the insulator plates. One terminal of the capacitors producing the transverse capacitances is formed by the portion of the rod at the centre of the insulating plates, and the other terminal is formed by the coated layer P of the hole 2, against which the edge of the disk-like insulating plate bears. The outer periphery of the ceramic plate is coated with a conductive metal layer and at least one plate is soldered from thin layer to the coated layer of the hole. A conductive bonding agent can be used to fasten the plates to the coated layer of the hole if the plates are of a plastic compound. In the operating conditions of the filter this layer P is grounded. The insulator plates and the surfaces of the hole 2 in contact therewith and the surface of the rod 7 constitute a cylinder capacitance the value of which being dependent, as is well known in the art, on the thickness of the insulator plate 9–12, on the dielectric coefficient of the insulator plate, and on the radii of the hole 2 and of the rod 7. By changing these values the desired value for the transverse capacitance can be achieved. As shown in FIG. 2 the thickness of the insulating disks 9, 10, 11, 12 gradually decreases from the uppermost disk 9 to the lowermost disk 12. The inductance of the portions of the rod 7 between the insulator plates is mainly affected by the length of each rod portion between the insulating plates so that the inductance can be affected by making the rod straight, as shown in FIG. 2, or the rod portions between the insulator plates can be made wave-like, as shown in FIG. 3, spiral or some other shape. FIG. 3 is simplified and shows only a part of the cross-section of the first resonator 2 as shown in FIG. 2, wherein only the two topmost insulator plates 9 and 10 are visible. The reference numerals are the same as in FIG. 2. The input signal into the entire filter structure is applied from the lower end of the rod 7, and the signal in which the harmonic frequencies have been attenuated is coupled to the first resonator of the ceramic filter at the upper end of the rod 7.

The attenuation of the harmonic frequencies can be enhanced further by additionally placing in an analogous way a second harmonic filter in the hole 3 of the last resonator. The second harmonic filter similarly consists of a rod 7' and disk-like insulator plates 9', 10', 11' and 12'. The mutual spacing between the plates and their dimensions are selected to conform to the desired attenuation properties. The signal from the ceramic resonator is coupled to the harmonic filter on the output side from the upper end thereof, and from the lower end of the rod is derived the output signal OUT. In other respects, the same holds good for the description of the present filter as above.

The serial inductance of the transverse branch described is very small in comparison with the capacitor and it can be disregarded in the equivalent circuit. Thus, the harmonic filter positioned in the hole of the ceramic filter is a ladder network in which the transverse capacitances and longitudinal inductances are transposed, i.e. the filter is a low pass filter. Referring to FIG. 2, the high frequency is applied to the harmonic filter from the lower end thereof, the incoming direction being marked with IN. The signal proceeds along the described ladder network, and at the upper end of the rod 7 there appears a signal from which the frequencies higher than the desired frequency have been filtered off. This signal is coupled from the upper end into the main ceramic filter and to the first resonator thereof. In the curve concerning the transmission of the ceramic filter, no peaks caused by the harmonic frequencies are now visible. If also a harmonic filter is positioned in the last resonator of the ceramic filter, the output signal of the entire filter is derived from the lower end thereof. In this instance the ends of the central conductors of the harmonic filters are also the input and output terminals of the ceramic filter.

With the filter of the invention the transmission of harmonic frequencies by the ceramic filter can be prevented. The harmonic filter can be made very small in size and, positioned inside a hole of the resonator so that the outer dimensions of the overall filter are not affected. Insertion losses can be relatively small and the bandwidth relatively wide. The positioning makes it also very well RF-shielded. The harmonic filter can be implemented using a number of technologies known in the art, for instance in the same way as in manufacturing metal-film resistors or tubular inductances. The invention is applicable with dielectric filters other than ceramic filters. Moreover, the may comprise any number of resonators depending on desired filter characteristics.

I claim:

1. A filter comprising:

a body of dielectric material having upper and lower surfaces, the body having portions coated with a conductive material, and at least two holes extending from the upper surface towards the lower surface and being coated with the conductive material, whereby a respective transmission line resonator is formed for each hole; and means in at least one of the resonator holes for filtering frequencies higher than the desired operating frequency of the filter, the means for filtering frequencies higher than the desired operating frequency of the filter comprising an elongate conductive material, and a plurality of insulating disk-like members provided in space-apart relationship along the length of the elongate member.

2. A filter as claimed in claim 1, wherein the disk-like members are fastened to the elongate member.

3. A filter as claimed in claim 1, wherein the elongate conductive member is provided substantially concentrically in the hole.

4. A filter as claimed in claim 1 or claim 2, wherein the outer periphery of at least one of the disk-like members is contiguous with the conductive coating in the hole.

5. A filter as claimed in claim 1 or claim 2, wherein the disk-like members are formed of a ceramic material.

6. A filter as claimed in claim 1 or claim 2, wherein at least one of the elongate conductive member extends out of the hole and constitutes an input terminal.

7. A filter as claimed in claim 1 or claim 2, wherein the elongate conductive member has a bent portion between the insulating disk-like members.

8. A filter as claimed in claim 1 or claim 2, wherein the means for filtering frequencies higher than the desired operating frequency of the filter comprise a first elongate conductive member provided in a first resonator hole, and a second elongate conductive member provided in a second resonator hole, each of said first and second elongate conductive members being provided along their length with a plurality of respective insulating disk-like members.

9. A filter as claimed in claim 8, wherein the resonator holes are present in a row, and the first and second elongate conductive members are provided respectively in the outermost resonator holes.

10. A filter as claimed in claim 9, wherein at least one end of each of the first and second elongate conductive members extends out of the holes in which they are provided and constitutes respective input and output terminals for the filter.

* * * * *